United States Patent [19]

Hofmann

[11] 4,137,019

[45] Jan. 30, 1979

[54] ROTARY PISTON MACHINE

[76] Inventor: Rudolf Hofmann, c/o Sullair Europe Corp., Wallensteinstrasse 20, 8192 Geretsried, Fed. Rep. of Germany

[21] Appl. No.: 766,383

[22] Filed: Feb. 7, 1977

[30] Foreign Application Priority Data

Feb. 6, 1976 [DE] Fed. Rep. of Germany ..... 2604665

[51] Int. Cl.[2] ..... F04B 19/02; F01C 7/00; F01C 19/00; F01C 21/02

[52] U.S. Cl. ..... 417/462; 418/97; 418/99; 418/129; 418/143; 418/164

[58] Field of Search ..... 418/97, 99, 161, 164, 418/166, 167, 168, 129, 143; 417/204, 462

[56] References Cited

U.S. PATENT DOCUMENTS

| | | | |
|---|---|---|---|
| 725,615 | 4/1903 | Cooley | 418/168 |
| 883,271 | 3/1908 | Wilson | 417/462 |
| 914,627 | 3/1909 | Alcorn | 418/168 |
| 1,897,190 | 2/1933 | Eyston | 417/462 |
| 1,918,408 | 7/1933 | Lakin-Smith | 417/462 |
| 3,280,812 | 10/1966 | Peras | 418/97 |
| 3,790,315 | 2/1974 | Emanuelsson et al. | 418/97 |
| 3,954,355 | 5/1976 | Paul, Jr. | 418/164 |

FOREIGN PATENT DOCUMENTS

| | | | |
|---|---|---|---|
| 1551120 | 9/1969 | Fed. Rep. of Germany | 417/462 |
| 1963369 | 6/1971 | Fed. Rep. of Germany | 418/129 |
| 1363724 | 5/1964 | France | 417/462 |
| 1010642 | 11/1965 | United Kingdom | 417/462 |

*Primary Examiner*—John J. Vrablik

*Attorney, Agent, or Firm*—Wegner, Stellman, McCord, Wiles & Wood

[57] ABSTRACT

A rotary piston machine has a cylindrical housing with inlet and outlet ports. A rotor mounted in the housing has an elongated diametric recess. A circular piston eccentrically mounted in the recess effectively reciprocates therein as the rotors turn.

4 Claims, 3 Drawing Figures

ROTARY PISTON MACHINE

The present invention relates to a rotary piston machine, especially to a compressor, having a piston rotatably mounted in a housing and inlet and outlet openings in said housing.

Various embodiments of rotary piston machines of this type are well known, each requiring an elaborate configuration of the inner circumference of the housing or of the rotary piston. It is the object of the invention to design a rotary piston machine of the type mentioned above and of a very simple construction, which is suitable specifically as a compressor for small deliveries, but which may also be used as a pump, a compressed air motor and the like.

According to the invention, a rotor is rotatably mounted in a housing, said rotor having a diametrically extending recess in which the rotary piston is mounted eccentrically to the axis of rotation of the rotor to reciprocate in the recess while rotating in the same direction as the rotor.

As the rotor and housing form a rigid external jacket for the rotating piston, a very simple design of the rotary piston machine is possible. The diametrically extending recess in the rotor is defined by straight, parallel surface sections in the center area, and by curved surface sections at the ends, which correspond to the radius of the circular rotary piston.

In order to obtain the reciprocating movement of the rotary piston in the longitudinal recess in the rotor, the rotary piston is eccentrically arranged on a shaft which is mounted eccentrically to the axis of rotation of the rotor in the housing. Preferably, the speed ratio between the rotary piston and the rotor is 2:1. The rotor and piston are linked by a synchronizing gear which does not transmit any power.

Further features and advantages will be apparent from the following description and from the drawings, in which.

Figure 1:
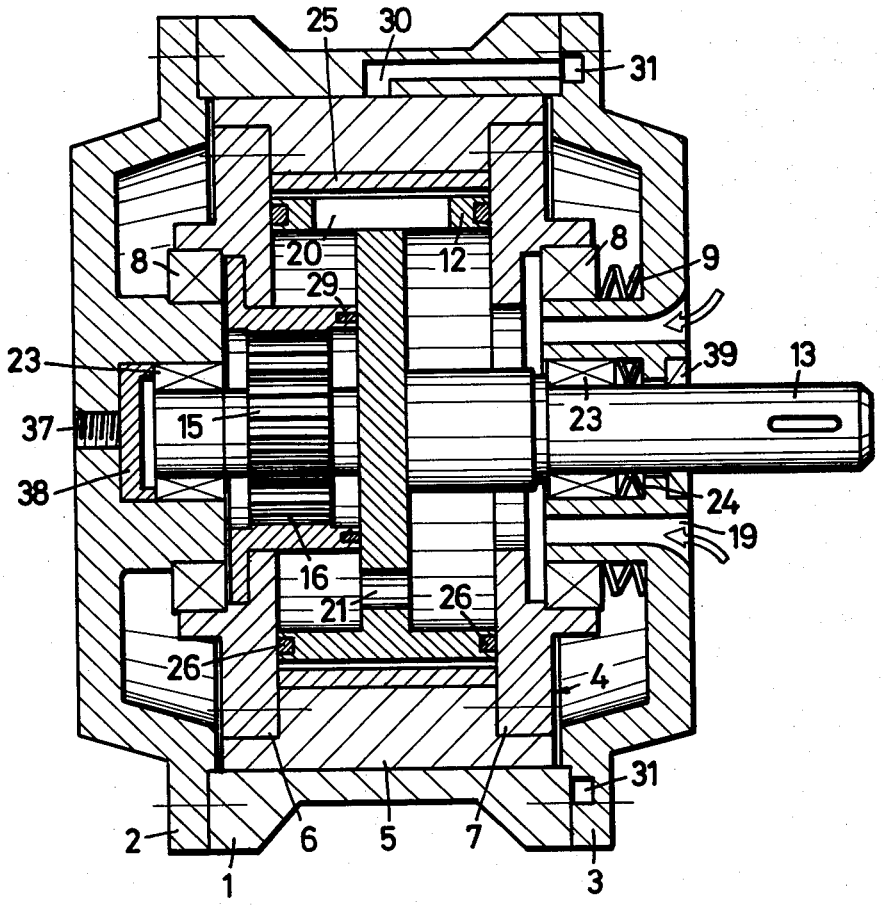
FIG. 1 is a schematic longitudinal section of a compressor taken along line I—I of FIG. 2.

The housing of said compressor is formed by an annular jacket 1 and cover-like lateral plates 2 and 3, said plates being connected to the annular jacket 1 by means of bolts (not shown). A suitable seal may be provided between these elements. In this stationary housing a rotor 4 is rotatably mounted, whose circular outer circumference corresponds to the circular inner circumference of the housing. The rotor has an annular center with lateral end plates 6 and 7 bolted thereto. Bearings 8 rotatably mount rotor 4 in the housing covers 2 and 3. A spring, as cup spring 9, is arranged between one of bearings 8 and housing cover 3, said spring holding the rotor 4 adjacent to the opposite housing cover 2 or bearing 8 fixing said rotor 4 in the axial direction of the housing.

Figure 2:
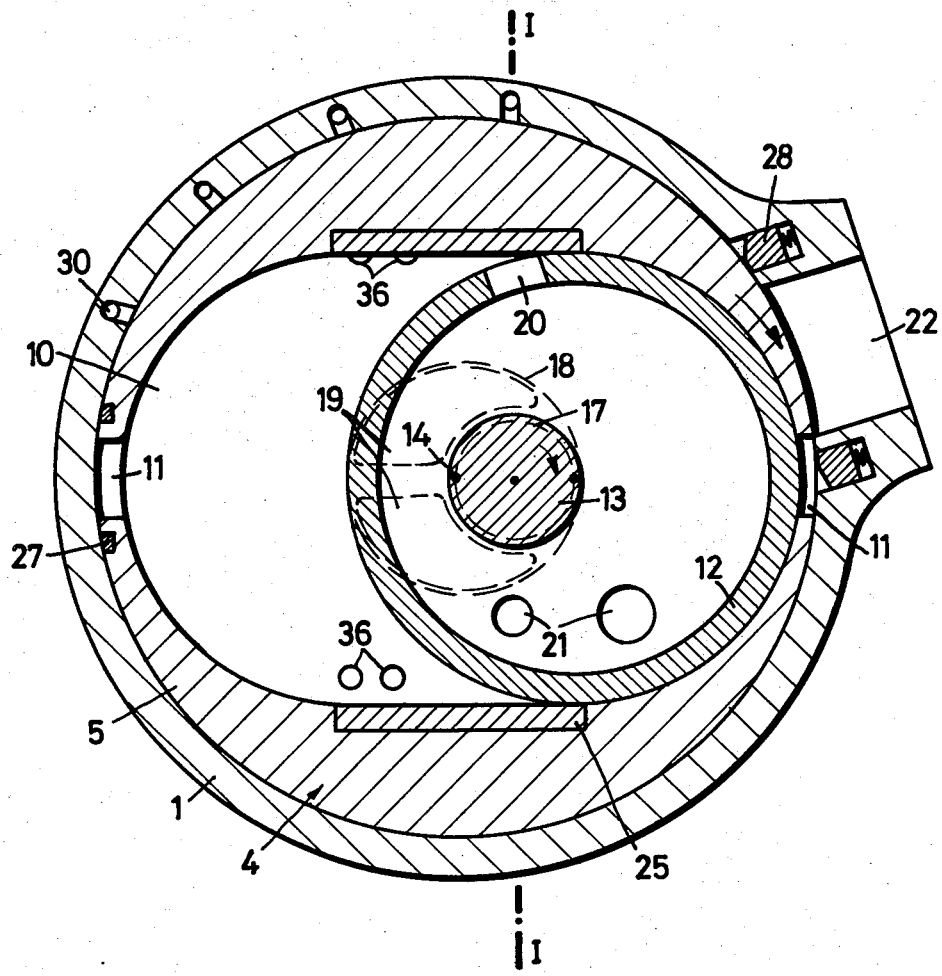
FIG. 2 is a transverse section of said compressor.

As is shown by FIG. 2, the center section 5 of rotor 4 is provided with a diametrically extending recess 10 which is defined in the central area by straight, parallel sections and at the ends by semicircles. Within the area of arc sections of said recess 10, the rotor has opposite openings 11, which may have the form of a bore or of a slot extending in the axial direction of said rotor.

In recess 10 of said rotor 4, a rotary piston 12 is mounted, whose width in axial direction corresponds to that of said center section 5 of the rotor. The diameter of said circular rotary piston 12 corresponds to the distance between the parallel central sections of recess 10 opposite each other in said rotor 4, and the circular end sections of said recess correspond to the radius of said rotary piston 12. Rotary piston 12 is eccentrically mounted on a shaft 13 which is off-set in the housing from the axis of rotation 14 of rotor 4, as is depicted in FIG. 2. Rotary piston 12 and said rotor 4 are linked by a synchronizing gear, a pinion 15 mounted on said shaft 13 of the rotary piston and an internally toothed ring gear 16, which is mounted to the lateral plate 6 of rotor 4. The ratio of the pitch circles is 2:1 , so that the rotary piston 12 driven through shaft 13 rotates at twice the speed of said rotor 4. The pitch circle of said pinion 15 extends through both the center of said rotary piston 12 and the axis of rotation of said rotor 4. In FIG. 2, the pitch circle of pinion 15 is designated by numeral 17 and that of the internal gearing 16 by numeral 18.

When the rotary piston 12 is driven in the direction of rotation shown by an arrow in FIG. 2, the rotary piston performs a reciprocating movement on account of said arrangement in the recess 10 of said rotor 4, which rotates in the same direction of rotation at half the speed of said rotary piston. The recess 10 acts as a working chamber for the rotary piston 12, a reduction of the volume or compression taking place alternatively in the end areas of recess 10.

With the illustrated embodiment of a compressor, air is taken in at the hub area through inlet openings 19 in the lateral plate 3 of the housing. The air flows into the inner chamber of the rotary piston 12 which has a double T section and through an axial slot 20 in the periphery of rotary piston 12, to the working chamber 10 in rotor 4. The web section of said rotary piston 12 can be provided with one or more openings 21. The air compressed in the working chamber is expelled through openings 11 in said rotor 4 and an outlet port 22 in the center part of the housing. The intake ports 19 have a cross-sectional shape similar to a kidney as shown by phantom lines in FIG. 2. The shape results from the available space between the bearing 8 for rotor 4 and a bearing 23, which mounts shaft 13 in the lateral plate 3, and from a web (not shown) between the two openings 19 which strengthens the bearing area in said lateral plate 3. If the reinforcing were eliminated, the intake opening could be crescent shaped. Alternatively, the intake opening may be diametrically opposite the outlet port 22 at the outer circumference of the center section 1 of the housing.

The rotary piston 12 is mounted by bearings 23 at both sides in housing covers 2 and 3. Cup springs 24 act on bearing 23, pushing the rotary piston 12 in the same direction as said cup springs 9 push said rotor 4. In the embodiment depicted, said rotary piston 12 runs between the lateral parts 6 and 7 of said rotor 4, and it can follow any small shifting movements of said rotor in axial direction owing to the arrangement of said springs 9 and 23 at the same side.

Sealing plates 25 on the opposite straight sections of the recess seal off the working chamber formed by the recess 10. The sealing plates are under either the action of springs or of a pressurized fluid (not shown).

If an additional seal is desirable, a coating may be provided on plates 25 of a sealing material that has good running-in and emergency running properties, such as a babbitt metal. The circular end sections of recess 10 can remain practically unfinished if there is a sufficiently large clearance between the rotary piston and the rotor in the extreme positions, one of which is shown in FIG. 2. The peripheral surface of said rotary piston 12 is finished, however, in order to provide a smooth sliding surface, as the rotary piston slides with its whole periphery along the straight sections of the recess 10 during its rotational movement.

At the ends of the annular body forming the rotary piston 12 annular grooves (see FIG. 1) are provided, which carry a sealing strip 26. The inner surfaces of said lateral plates 6 or 7 of rotor 4 are finished in order to provide a good sealing. Possibly, the seal 26 extends over only the right half of the rotary piston 12 as seen in FIG. 2, as this part always produces the compression.

Around said openings 11 in said rotor 4, seals 27 are provided on the outer circumference of said rotor. In addition, a seal 28 is provided around outlet opening 22 on the inner circumference of said housing. The outer edge of sealing ring 28, which can be either spring-loaded or loaded by a pressure fluid, is chamfered, so that seals 27 around openings 11 in the rotor 4 can sweep past said sealing strip 28 without tilting.

The seal 29 between the ring gear 16 and the web section of the rotary piston 12 seals the area of said rotary piston through which operating fluid flows from the synchronizing gear which is lubricated by means of oil or grease. The synchronizing gear 15, 16 does not transmit any power, but only serves to synchronize the control movements of said rotor with regard to said rotary piston. A corresponding seal of bearings 8 and 23 from the compartment through which the operating fluid flows may be provided.

The compressor can work with oil injection. For this, bores 30 are provided which are distributed over the inner circumference of the center section 1 of said housing and which are connected by axial ducts with an annular groove 31 in one or both lateral plates 2 and 3 of the housing. The annular groove is connected to a suitable source of pressurized oil.

Figure 3:
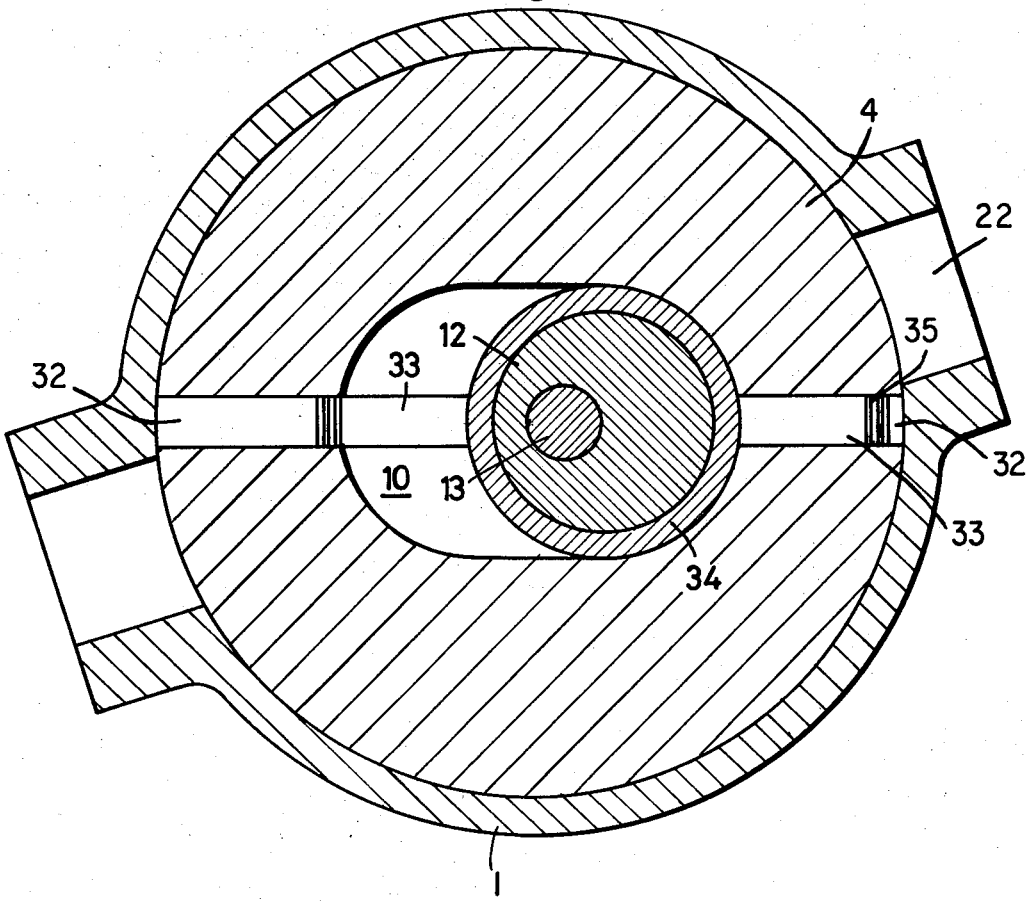
FIG. 3 is a schematic longitudinal section of a modified embodiment of the invention.

A further embodiment of the invention is schematically shown in FIG. 3. Along the axis of the longitudinally extending recess 10 in rotor 4 are diametric cylinder bores 32, in which run pistons 33. The reciprocating pistons can slide directly on the outer circumference of rotary piston 12 which operates as a drive eccentric. Preferably, however, an annular sleeve 34 concentrically surrounds rotary piston 12, sliding thereon and having pistons 33 connected thereto. The pistons 33 can have piston rings 35.

The construction of FIG. 3 may provide a two-stage compressor, the first stage being in working chamber 10 and the second stage in cylinder bores 32. For such operation, compression chamber 10 can be flooded by oil while said pistons 33 run dry, to achieve a higher pressure ratio.

If an oil injection is provided in compression chamber 10, the oil may be introduced under pressure through bores 30 distributed over the inner circumference of said housing. Preferably, the oil is injected through port 11 in rotor 4 shortly before the beginning of the compression. At the beginning of the compression in working chamber 10, opening 11 sweeps a section on the inner circumference of said housing 1 on which bores 30 are arranged and through which oil is injected under pressure. The compressor process can be concluded without a further oil injection. In FIG. 2, the arrangement of said bores 30 is depicted only schematically.

If the lateral surfaces of rotor 4 and rotary piston 12 rest against stationary parts of said housing or against the lateral walls of housing 1, the oil supply bores as are shown schematically by 36 in FIG. 2 may be provided in these lateral walls. The oil supply bores 36 are preferably so arranged that the oil is injected at the beginning of a compression chamber 10, as both a sealing and a lubrication are intended on said surface. In FIG. 2, juxtaposed bores 36 are only schematically sketched, but such oil injection bores 36 may be arranged in conformity with the motion cycle of rotor 4 relative to rotary piston 12 over a curved section which results from the relative movement between rotor 4 and rotary piston 12. The oil injection can thus follow the moving straight sealing surfaces of the compression chamber 10 over a certain range of the compression.

It may also be suitable to inject the oil intermittently into said compression chamber 10, and the oil pressure required only exists at said injection bores when these are exposed towards said compression chamber 10. The injected oil is exhausted with the compressed air through said outlet opening 22, whereupon the compressed air is cleaned from oil by means of an oil separator.

A further possibility of oil injection utilizes oil ducts (not shown) through the shaft of rotary piston 12, and running from said shaft to the circumference of said rotary piston. The oil can be injected directly into the sealing clearance between the outer circumference of said rotary piston 12 and the straight sections of said compression chamber 10.

The optimum amount of the fluid injection, which depends on the design and the operating data of the particular compressor, on the type of fluid injected and the like, can be provided according to the specific requirements. It is preferably determined according to the formula $m_f = m_g \cdot \xi$, the factor $\xi$ being within the range from 0 to 12, $m_f$ being the mass of the fluid and $m_g$ of the air, per time unit.

As is depicted in the drawings, the compressor is particularly suitable for small deliveries. The components of the compressor are of a simple configuration and can easily be machined. The lateral plates 6 and 7 of the rotor and also the lateral plates 2 and 3 of said housing may have an identical configuration if the intake opening is on the outer circumference. Likewise, a simple assembly of the compressor is possible, as can be seen from FIG. 1. The rotary piston 12 can be made free from forces due to inertia by means of a suitable arrangement of weights or by providing a thicker wall. Rotor 4 has a symmetrical configuration and balancing is unnecessary.

Adaptation of the compressor to different delivery rates can be made by selecting the width or axial dimension of rotary piston 12 and of rotor 4. Two or more of such compressors may also be connected in series in a simple way. Such a compressor is particularly suitable for an integral construction. An air filter may be mounted axially of the housing. Equally, an oil separator may be mounted immediately adjacent to the housing in axial direction, in case an oil injection is provided.

In FIG. 1, a threaded bore 37 is arranged in the housing cover 2 on an extension of the axis of the shaft. A bolt with a lock nut (not shown) can be inserted in bore 37 for adjusting the bearings and thus the axial position of the rotary piston and the rotor. The bolt bears on a disc 38 with a ring collar adjacent bearing 23. At the opposite side, the compression springs 24 are provided at said bearing 23. Retaining ring 39 surrounds shaft 13.

Modified embodiments of the construction illustrated are possible. So, for instance, in a simplified configuration the rotary piston 12 can run directly between the lateral parts of the housing and the bearing of the rotor can be transferred to the outside. Cooling fins can be provided on the outer surface of the housing adjacent outlet opening 22. The principle of the rotary piston engine according to the invention, having a rotor rotatable in a housing and a rotary piston which is eccentrically mounted in said rotor to perform a reciprocating movement, can also work as a pneumatic motor or as an expansion machine. In the case of an embodiment as a fluid pump, the intake may extend suitably far over the circumference of the rotor. In the case of an oil injection, the oil bores may also be provided with adjustable throttles and may also be distributed over the whole circumference. Other arrangements of these openings 11 and 20 may be provided as well.

The working chamber in rotor 4 may also have a different shape. The dimension of the straight surface sections is preferably determined by the diameter of the pitch circle 18 of the ring gear. A bulging adjacent the straight surfaces may be provided to leave a residual volume within the compression range when said rotary piston is in its right-hand end position as shown in FIG. 2. The inner circumference of the housing may also have another configuration. For the embodiment shown, it is essential that, for sealing purposes, the rotor is adjacent to the inner circumference of the housing in the range of the outlet opening. According to the application of the rotary piston machine, recess 10 can have different configurations at the end areas and this also applies to the inner circumference of the housing.

In order to remove the oil with a compressor provided with oil injection, the opening 11 in said rotor 4 is preferably moved a little farther in the direction of rotation than is depicted in FIG. 2. Openings 11 can be in the form of bores arranged over the width of rotor 4, and in the corners to improve the removal of the oil.

I claim:

1. A rotary piston machine including a housing having an inlet and at least one outlet and being formed by an annular jacket portion and a pair of lateral plate portions one on each side of said jacket portion, said jacket portion defining a circular inner circumference, a rotor within the housing and being formed by an annular center portion and a pair of lateral end portions one on each side of said center portion, said center portion having a circular outer circumference corresponding to the inner circumference of the housing and a diametrically extending recess acting as a working chamber with openings at each of the diametrically opposed ends of the recess communicating exteriorly of the rotor, said rotor being adapted to rotate within the housing to move said openings into and out of communication with said outlet, a rotary piston positioned within said recess and adapted to reciprocate between the ends of said recess, and a shaft having a rotational axis eccentric of the rotational axis of the rotor to which the rotary piston is secured, wherein the improvement comprises:

a pair of first bearing means one at each side of said rotor for mounting the rotor for rotation within said housing;

a pair of second bearing means one at each side of said rotary piston for mounting the shaft and the rotary piston for rotation within the housing;

first spring means for biasing the first bearing means toward one side of the housing and resiliently locating said first bearing means; and second spring means for biasing the second bearing means in the same direction as said first bearing means and resiliently locating said second bearing means.

2. The rotary piston machine of claim 1 further including means reacting at one end of the shaft at said one side and carried by the housing plate portion at said one side for selectively adjusting the axial position of the bearing means and the axial position of the rotary piston and the rotor by effecting movement thereof against spring force.

3. The rotary piston machine of claim 2 wherein said adjusting means includes a disc with a ring collar adjacent the outer end of said second bearing means at said one side and a bolt threaded into the housing plate portion at said one side to abut the outward side of said disc.

4. A rotary piston machine including a housing having an inlet and at least one outlet and being formed by an annular jacket portion and a pair of lateral plate portions one on each side of said jacket portion, said jacket portion defining a circular inner circumference, a rotor within the housing and being formed by an annular center portion and a pair of lateral end portions one on each side of said center portion, said center portion having a circular outer circumference corresponding to the inner circumference of the housing and a diametrically extending recess acting as a working chamber with openings at each of the diametrically opposed ends of the recess communicating exteriorly of the rotor, said rotor being adapted to rotate within the housing to move said openings into and out of communication with said outlet, a rotary piston positioned within said recess and adapted to reciprocate between the ends of said recess, and a shaft to which the piston is secured extending through the rotor and having a rotational axis eccentric of the rotational axis of the rotor, wherein the improvement comprises:

a raised cylindrical boss respectively defined by each of said housing plate portions at each side of the housing extending inwardly into the interior of the housing;

an annular external flange respectively defined by each of said rotor end portions extending outwardly toward the respective housing plate portions and being spaced radially outward from its associated boss;

a pair of first bearing means one at each side of said rotor between the respective bosses and the external flanges for mounting the rotor for rotation within said housing;

a pair of second bearing means one at each side of the rotary piston between the respective bosses and the shaft for mounting the shaft and the rotary piston for rotation within the housing;

first spring means between one of said housing plate portions and the associated first bearing means for biasing the associated first bearing means toward the other housing plate portion and resiliently locate said first bearing means; and second spring means between said one housing plate portion and its associated second bearing means for biasing the associated second bearing means in the same direction as said first bearing means and resiliently locate said second bearing means.

* * * * *